US007396110B2

(12) United States Patent
Matsumoto et al.

(10) Patent No.: US 7,396,110 B2
(45) Date of Patent: Jul. 8, 2008

(54) INK CONTAINER AND MOUNTING METHOD OF THE INK CONTAINER

(75) Inventors: Nobuyuki Matsumoto, Tokyo (JP); Hajime Kaneko, Kodaira (JP)

(73) Assignee: Canon Kabushiki Kaisha, Tokyo (JP)

( * ) Notice: Subject to any disclaimer, the term of this patent is extended or adjusted under 35 U.S.C. 154(b) by 336 days.

(21) Appl. No.: 11/234,098

(22) Filed: Sep. 26, 2005

(65) Prior Publication Data

US 2006/0066696 A1 Mar. 30, 2006

(30) Foreign Application Priority Data

Sep. 27, 2004 (JP) ..... 2004-279839

(51) Int. Cl.
*B41J 2/14* (2006.01)

(52) U.S. Cl. ..... 347/49

(58) Field of Classification Search ..... 347/37, 347/49, 86, 87

See application file for complete search history.

(56) References Cited

U.S. PATENT DOCUMENTS

| | | | | |
|---|---|---|---|---|
| 5,619,237 | A | 4/1997 | Inoue et al. | 347/87 |
| 5,815,183 | A * | 9/1998 | Sasaki | 347/86 |
| 5,953,030 | A | 9/1999 | Ishinaga et al. | 347/86 |
| 6,113,230 | A | 9/2000 | Ishinaga et al. | 347/86 |
| 6,155,678 | A | 12/2000 | Komplin et al. | 347/86 |
| 6,168,266 | B1 | 1/2001 | Ishinaga et al. | 347/86 |
| 6,302,532 | B1 | 10/2001 | Ishinaga et al. | 347/86 |
| 6,332,674 | B1 | 12/2001 | Kamiyama et al. | 347/86 |
| 6,336,719 | B1 | 1/2002 | Ishinaga et al. | 347/86 |
| 6,428,154 | B1 | 8/2002 | Kamiyama et al. | 347/86 |
| 6,431,697 | B1 * | 8/2002 | King et al. | 347/86 |
| 6,478,416 | B2 | 11/2002 | Ishinaga et al. | 347/86 |
| 6,490,792 | B1 | 12/2002 | Ishinaga et al. | 29/890.1 |
| 6,863,376 | B2 * | 3/2005 | Seino et al. | 347/49 |
| 6,997,548 | B2 * | 2/2006 | Matsuo et al. | 347/86 |

FOREIGN PATENT DOCUMENTS

| | | |
|---|---|---|
| JP | 5-16377 | 1/1993 |
| JP | 5-162323 | 6/1993 |
| JP | 8-58107 | 3/1996 |
| JP | 8-108546 | 4/1996 |
| JP | 9-267485 | 10/1997 |
| JP | 2001-105587 | 4/2001 |

* cited by examiner

*Primary Examiner*—Anh T. N. Vo
(74) *Attorney, Agent, or Firm*—Fitzpatrick, Cella, Harper & Scinto

(57) ABSTRACT

An ink container capable of being simply mounted in a holder with a small working space includes a rib-like guide portion for determining a mounting path during mounting of the ink container in a head cartridge at a side surface. The head cartridge includes a holder portion provided with a sliding projection which slides in contact with the guide portion. When the ink container is mounted, a user moves the ink container so that a first inclined portion first contacts the sliding projection and thereafter the ink contained is moved in an obliquely below direction toward the head cartridge while sliding the sliding projection along the first inclined portion.

4 Claims, 8 Drawing Sheets

INK CONTAINER AND MOUNTING METHOD OF THE INK CONTAINER

FIELD OF THE INVENTION AND RELATED ART

The present invention relates to an ink container constituted detachably mountable to a holder and a method of mounting the ink container.

Heretofore, recording apparatuses for effecting recording with respect to a medium to be recorded such as paper, cloth, a plastic sheet, an OHP sheet, or the like (hereinafter, simply referred to as "recording paper") have been proposed as those to which a recording head of various recording modes, such as a wire dot mode, a heat-sensitive mode, a thermal transfer method, and an ink jet recording mode is mountable. Of these recording modes, the ink jet recording mode is a nonimpact mode in which ink is ejected from an ejection outlet (nozzle) onto the recording paper and is known as a mode capable of performing a high-density and high-speed recording operation with low noise. Further, the ink jet recording apparatus also has the advantages such that it has low running costs, can be reduced in apparatus size, and is easily ready for color image recording by using a plurality of color inks.

For these reasons, the ink jet recording made is utilized in output means of information processing systems, such as printers as output terminals of a copying machine, a facsimile apparatus, an electronic typewriter, a word processor, a work station, etc., or handy or portable printers provided to a personal computer, a host computer, an optical disk apparatus, a video apparatus, etc., and is commercially available as the printers.

Further, in the ink jet recording apparatus, in order to cut the running costs as one of purposes, such a constitution that an ink container is replaceable is adopted. As a type of the ink container, there have been known a type wherein a recording head having a function of ejecting ink (also called "ink jet head") and a container which contains ink are integrally formed (this type is also called a "chip type"), a type wherein the ink container is substantially consisting only of a container which contains ink, etc. In either type, it is desirable that the ink container is constituted so as to be simply replaceable with good workability, from the viewpoint of usability. Further, a replacing operation of the ink container is performed in a housing of the recording apparatus in many cases. For this reason, in addition to the workability during the replacement, it is desirable that the ink container can be replaced in a relatively small working space in view of a small-sized recording apparatus.

A constitution which is improved in workability during the ink container replacement is, e.g., disclosed in Japanese Laid-Open Patent Application (JP-A) 2001-105587. FIG. 9 is a perspective view showing an ink container and a holder for holding the ink container described in JP-A 2001-105587.

As shown in FIG. 9, an ink container 214 is provided with guide recesses 268 elongated linearly in a vertical direction at both side surfaces thereof. Further, in correspondence with these recesses, projections (not shown) to be engaged with the recesses 268 are formed at inner side surfaces of a holder 212. For a mounting operation of an ink container 214, first, the ink container 214 is moved in a horizontal direction to a position where the guide recesses 268 and the projections are to be engaged with each other and then is moved down toward the holder 212 as shown by an indicated arrow. When the ink container 214 is moved down to a predetermined position, a latch member 284 is engaged with an engaging portion of the holder 212. As a result, the ink container 214 is fixed in the holder 212.

However, in the conventional constitution as described in JP-A 2001-105587, when the ink container is mounted in the holder, it is necessary to engage the linear guide recesses of the ink container with the projections of the holder. Particularly, the guide recesses have a relatively small width in a lateral direction thereof, so that there has arisen such a problem that it is relatively difficult to engage the guide recesses with the projections per se. Further, in the conventional constitution, the mounting direction of the ink container is the vertical direction, so that it is necessary to ensure a relatively large working space above the holder. As a result, it is necessary to ensure a larger working space in a housing of a recording apparatus during the mounting operation. For this reason, a size of the entire recording apparatus is liable to be large.

SUMMARY OF THE INVENTION

An object of the present invention is to solve the above described problems.

A specific object of the present invention is to provide an ink container capable of simply performing a mounting operation thereof with respect to a holder in a small working space.

Another object of the present invention is to provide a mounting method of mounting the ink container.

According to an aspect of the present invention, there is provided an ink container, comprising:

an ink container main body which is provided with a supply port for supplying ink contained therein to an outside and has a substantially rectangular parallelepiped shape; and a latch lever formed at a first side surface of the ink container main body; the ink container being finally fixed in a holder by being moved from above the holder provided to a recording apparatus toward the holder;

wherein the ink container main body further comprises a guide portion, for determining a mounting path during mounting of the ink container in the holder, at a second side surface of the ink container main body other than the first side surface at which the latch lever is formed; and wherein the guide portion has a first guide surface which first contacts a part of the holder during the mounting, the first guide surface being formed continuously over a predetermined length in a shape for bringing the ink container close to the holder in an oblique direction.

In accordance with the above constituted ink container of the present invention, as an initial step during mounting of the ink container in the holder, the first guide surface at the side surface of the ink container may be first caused to contact a part (sliding projection) of the holder. Here, the first guide surface is continuous over a predetermined length, so that it is possible to ensure contact of the first guide surface with the part of the holder in a relatively broad range even when positioning by a user is somewhat deviated from a predetermined position. More specifically, compared with the conventional constitution required to engage the guide recesses of the ink container with the projections of the holder with relatively good positional accuracy, it becomes possible to simply perform mounting (particularly positioning at the initial stage) of the ink container. Further, first guide surface has such a shape that the ink container is caused to be close to the holder in an oblique direction, so that it becomes possible to reduce the working space above the holder when compared with the conventional constitution requiring the vertical direction as the mounting direction of the ink container.

According to another aspect of the present invention, there is provided a ink container mounting method of mounting in a holder an ink container which comprises an ink container main body which is provided with a supply port for supplying ink contained therein to an outside and has a substantially rectangular parallelepiped shape; and a latch lever formed at a first side surface of the ink container main body; wherein the ink container main body further comprises a guide portion, for determining a mounting path during mounting of the ink container in the holder, at a second side surface of the ink container main body other than the first side surface at which the latch lever is formed; and the mounting method, comprising:

a step of moving the ink container toward the holder so as to be close to the holder in an oblique direction by causing a guide surface which is formed as a part of the guide portion and is continuously over a predetermined length, to first contact a part of the holder and by sliding the guide surface in contact with the part of the holder;

a step of rotationally moving the ink container by sliding another part of the guide portion in contact with the part of the holder; and a step of fixing the ink container in the holder by further moving the ink container toward the holder, after being rotationally moved, to engage the latch lever with the holder.

As described above, according to the ink container and the mounting method thereof in the present invention, the main body of the ink container is provided with the guide portion for determining a mounting path of the ink container during mounting of the ink container at a side surface of the ink container main body. Further, the guide portion has the guide surface continuously extended over a predetermined length at a position where a part of the holder first contacts the guide portion during the mounting of the ink container, so that the user can perform a mounting operation simply without effecting precise positioning. Further, the guide surface is formed in a shape so that the ink container is moved toward the holder in an oblique direction. As a result, a working space above the holder required to mount the ink container can be reduced, thus resulting in realization of a small-sized entire apparatus.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings.

First Embodiment

Figure 1:
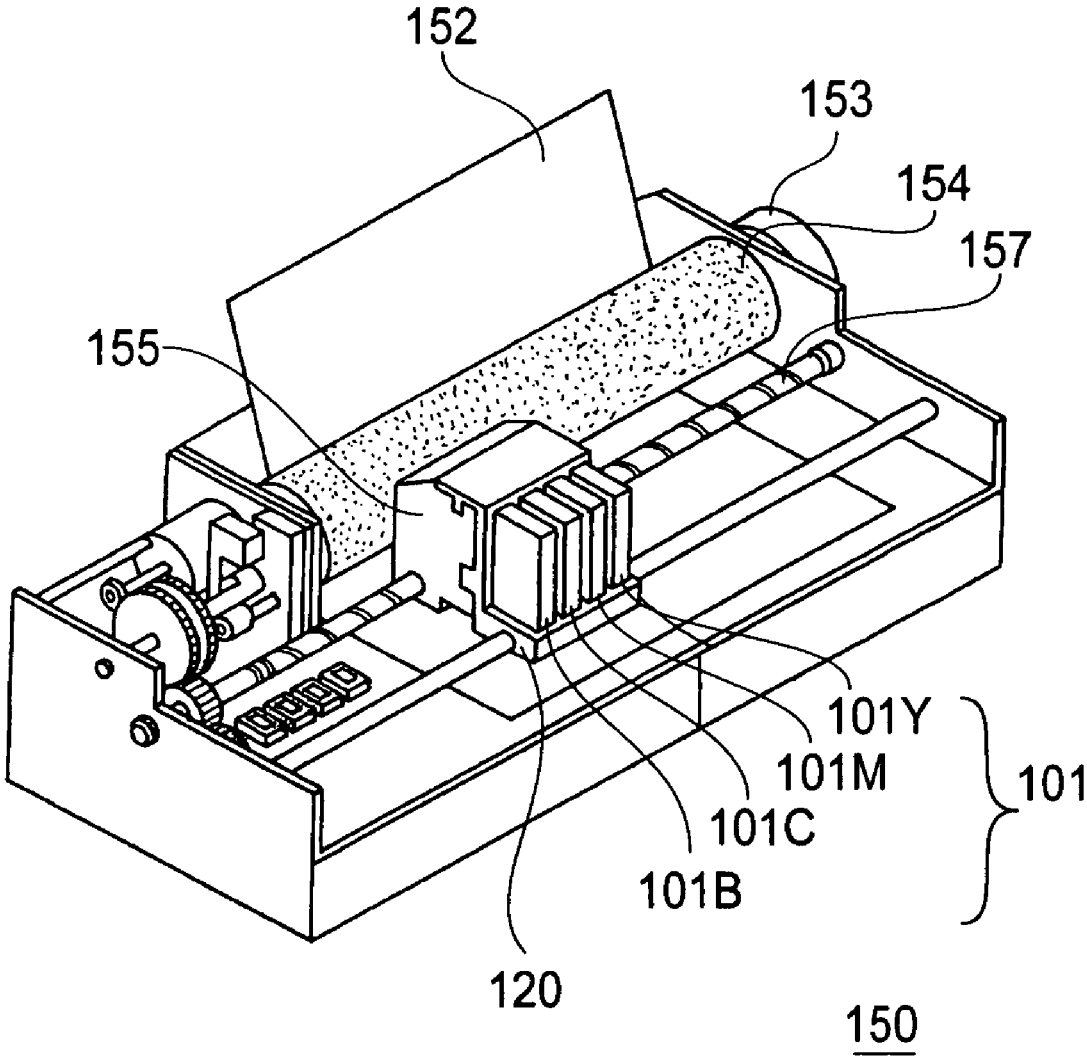
FIG. 1 is a perspective view schematically showing a constitution of an ink jet recording apparatus used in First Embodiment of the present invention.

First, an example of an ink jet recording apparatus to which an ink container according to this embodiment will be described with reference to FIG. 1. FIG. 1 is a perspective view showing a constitution of the ink jet recording apparatus in this embodiment.

As shown in FIG. 1, an ink jet recording apparatus 150 includes a paper feed roller 154 for feeding a medium 152 to be recorded (simply referred to as "recording medium"), a head cartridge 120 for holding ink containers 101 of respective colors and ejecting ink to the recording medium 152, a carriage 120 for holding the head cartridge 120 and causing the head cartridge 120 to be reciprocally moved on the recording medium 120 in a width direction of the recording medium 120. Incidentally, the ink jet recording apparatus 150 is used at a position such that the ink containers 101 are located in front of the recording apparatus 150 when viewed from a user.

The paper feed roller 154 is, more specifically, constituted so that it is rotationally driven by a motor 153. During a recording operation, the paper feed roller 154 feeds the recording medium by a predetermined pitch. The head cartridge 120 is constituted as a holder for detachably holding four ink containers 101B, 101C, 101M and 101Y of black, cyan, magenta and yellow, respectively. A detailed constitution of the head cartridge 120 will be described later with reference to other drawings. The carriage 155 is constituted so that it is moved along a guide rail 157 disposed so as to be extended in a direction perpendicular to a feed direction of the recording medium 152. Incidentally, the movement direction of the carriage 155 is also referred to as a "main scanning direction".

In the above constituted ink jet recording apparatus 150, ink is ejected from the head cartridge 120 toward the recording medium 152 while moving the carriage 155 in the main scanning direction in such a state that the feeding of the recording medium 152 is stopped, whereby recording for one line is effected on the recording medium 152. Then, the paper feed roller 154 is driven to feed the recording medium 152 by a predetermined pitch and recording by the above described head cartridge is effected again. As described above, by repeating the feeding operation and the recording operation for one line, it is possible to form a desired image on the recording medium 152.

Figure 2:
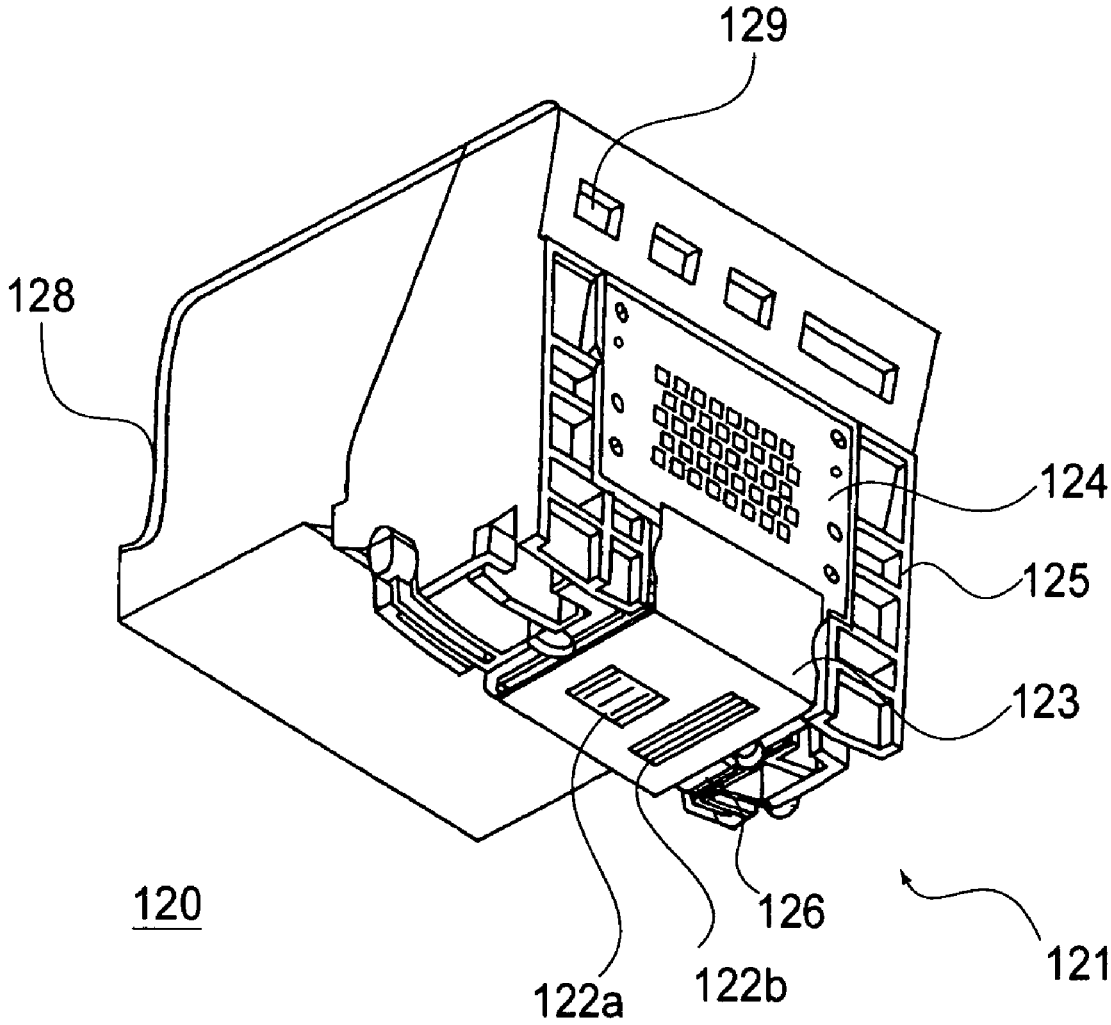
FIG. 2 is a perspective view of a head cartridge mounted in the ink jet recording apparatus shown in FIG. 1 when viewed from below the head cartridge.
Figure 3:
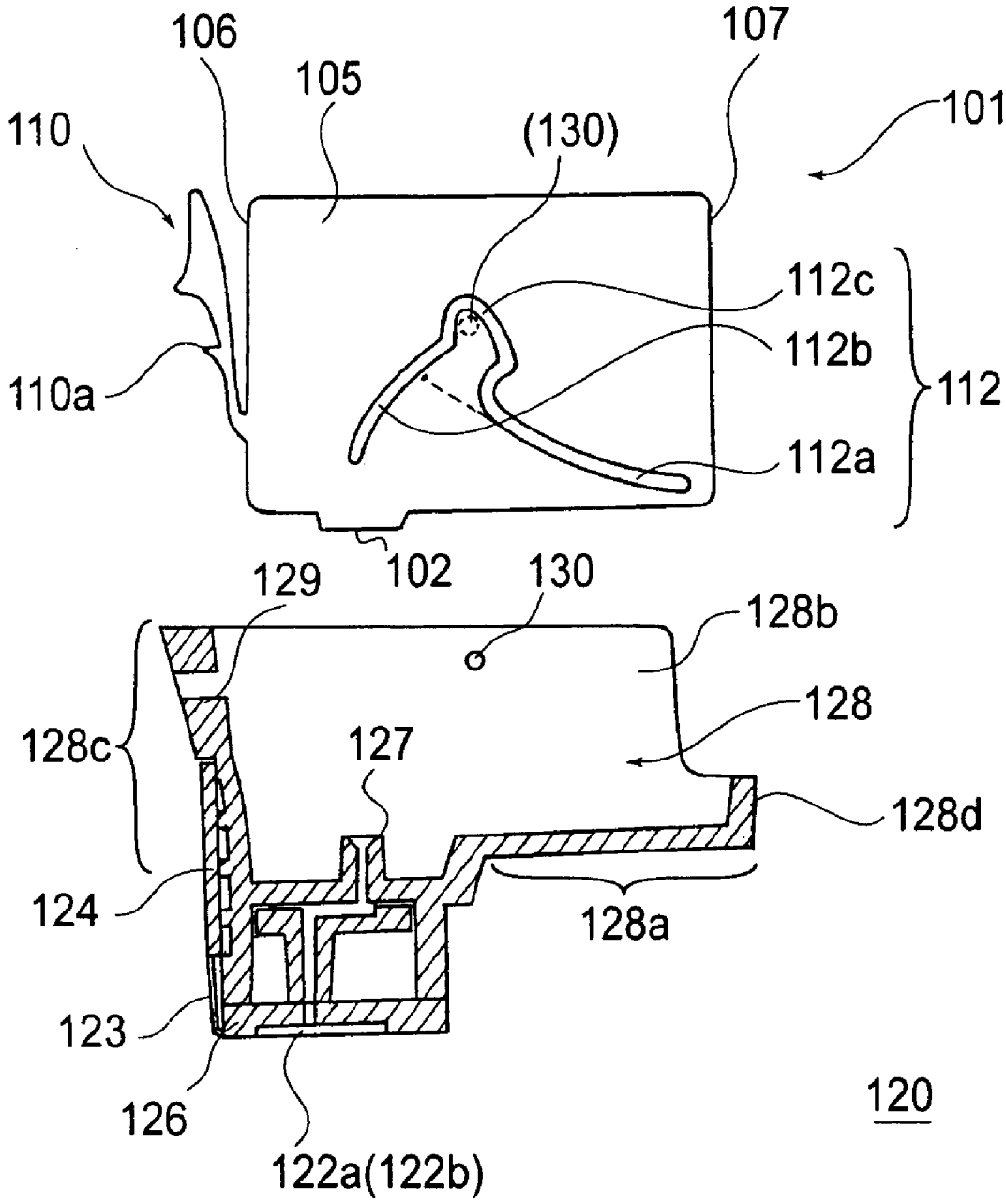
FIG. 3 is a sectional view showing a constitution of the head cartridge and a constitution of an ink container used in First Embodiment.

Next, with reference to FIGS. 2 and 3, the constitution of the head cartridge 120 will be described. FIG. 2 is a perspective view when the head cartridge 120 is viewed from below the head cartridge 120. FIG. 3 is a schematic view for explaining constitutions of the head cartridge 120 and the ink container 101 and in FIG. 3, a longitudinal sectional view of the head cartridge 120 is shown.

The head cartridge 120 includes a recording head portion 121 as a structural portion for ejecting ink and a holder portion 128 as a structural portion for holding the ink containers 101 of respective colors.

The recording head portion 121 is provided with recording chips (color chips) 122*a* for ejecting inks of cyan, magenta and yellow and a recording chip (black chip) 122*b* for ejecting black ink. These chips 122*a* and 122*b* are basically constituted similarly. Although a detailed constitution is not shown, each chip includes a heater board provided with a plurality of electrothermal elements for generating foams on the basis of an electric signal and a drive voltage which are sent from the recording apparatus, ink ejection ports for ejecting the ink by the above generated foams, and a nozzle plate on which a supply passage for supplying the ink to the ink ejection ports is formed. Further, the recording chips 122*a* and 122*b* are attached to a substrate 126 (FIG. 3) on which an ink supply passage for guiding the ink from the ink container 101 is formed. By such a constitution, the recording chips 122*a* and 122*b* are fixed with positional accuracy.

The recording chips 122*a* and 122*b* are electrically connected to a contact substrate 124 having electrical contacts with the recording apparatus through an electrical wiring tape 123. Incidentally, the electrical wiring tape 123, the contact substrate 124, and the above described substrate 126 are attached to a joint supporting portion 125 which is integrally formed with a holder 128. At the joint supporting portion 125, the ink supply passage (not shown) for guiding the ink from the ink container 101 and a filter (not shown) for removing contamination in the ink, and the like are formed.

The holder portion 128 is the structural portion disposed at an upper portion of the head cartridge 120. As shown in FIG. 3, the holder portion 128 is provided with a front surface-holding portion 128*a* for supporting a bottom surface of the ink container 101, and side walls 128*b* and a rear side wall 128*c* which are formed substantially perpendicular to the front surface-holding portion 128*a*. In FIG. 3, only one of the side walls 128*b* is shown but two side walls 128*b* are formed so that the ink container 101 is sandwiched therebetween.

In the neighborhood of the front surface-supporting portion 128*a*, the joint portion 127 which is a joint portion with an ink supply port 102 disposed at the bottom surface of the ink container 101 is formed so that it is projected upward. Further, at each of the side walls 128*b*, a sliding projection 130 for contacting a rib-like guide portion 112 provided at a side surface of the ink container described later is formed so that it is projected from the wall surface. Further, at the rear side wall 128*c*, a latch hole 129 for latching a latch lever 110 provided at a side surface of the ink container described later is formed.

The sliding projection 130 may be integrally formed with a member of the holder portion 128 or may be formed of a member other than the member of the holder portion 128. Further, a shape of the sliding projection 130 is not particularly limited but may preferably be constituted, in view of smooth sliding of the sliding projection 130 with the guide portion 112, so that the sliding projection 130 is, e.g., a columnar structure having a circular or elliptical cross section and contacts the guide portion 112 at a peripheral side surface thereof.

Further, from an end portion at the front (right) side of the front surface-supporting portion 128*a*, a front side wall 128*d* for holding a corner portion of the ink container 101 and having a positioning function is formed but this portion is close to user's hand during a replacement operation of the ink container, so that the front side wall 128*d* is formed at a low level in order to improve workability. In the case where the front side wall 128*d* is formed at the same level as the rear side wall 128*c*, e.g., when the ink container 101 is mounted, the ink container 101 is required to be moved in a raising manner so as not to interfere with the front side wall 128*d*. Such a constitution not only lowers the workability but also is disadvantageous for a small-sized recording apparatus in some cases.

Figure 4:
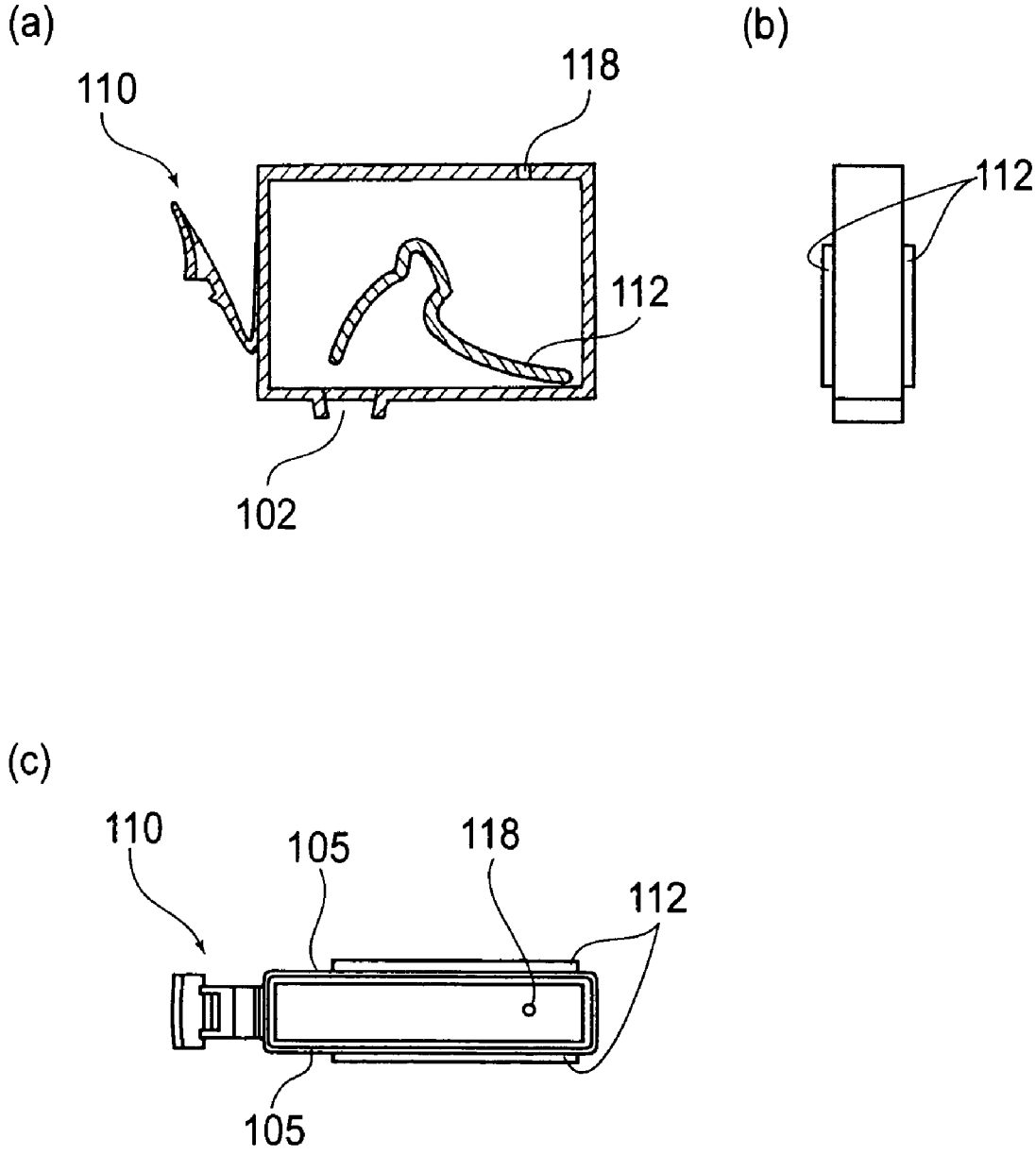
FIGS. 4(*a*) to 4(*c*) are schematic views for explaining a constitution of the ink container used in First Embodiment, wherein FIG. 4(*a*) is a longitudinal sectional view of the ink container, FIG. 4(*b*) is a side view of the ink container, and FIG. 4(*c*) is a top view of the ink container.

Next, an embodiment of the ink container according to the present invention will be described with reference to FIGS. 3 and 4. FIGS. 4(*a*) to 4(*c*) are schematic views for explaining a constitution of the ink container, wherein FIG. 4(*a*) is a longitudinal sectional view of the ink container, FIG. 4(*b*) is a side view of the ink container, and FIG. 4(*c*) is a top viewer of the ink container.

The ink container 101 shown in FIGS. 3 and 4 is characterized in that the rib-like guide portion 112 is provided at each of the side surfaces thereof but other constitutions are the same as those of the conventional ink container. The ink container 101 is constituted as a container which contains ink in an internal space and has a substantially rectangular parallelepiped shape. In FIGS. 3 and 4, two maximum-area surfaces of all the side surfaces are indicated as major side surfaces 105 and the remaining side surfaces are indicated as the rear side surface 106 and the front side surface 107.

At the rear side surface 106, an elastically movable latch lever 110 is disposed and provided with a latch claw 110*a* to be latched in the above described latch hole 129 of the head cartridge. Further, at an upper portion of the latch lever 110 is a finger-holding portion (not indicated by a reference numeral). The user moves the latch lever by holding the finder-holding portion with a finger when the ink container is removed, thus releasing engagement of the latch claw 110*a* with the latch hole 129 to permit removal of the ink container.

Further, as shown in FIGS. 4(*a*) to 4(*c*), at an upper surface and a lower surface of the ink container 110, an air communication hole 118 for causing the inside of the ink container to communicate with ambient air and the ink supply port 102 for supplying the ink contained in the ink container to the outside of the ink container are provided, respectively.

The guide portion 112 is a structural portion for determining a mounting pass of the ink container 101 by contacting the sliding projection 130 of the above-described head cartridge when the ink container 101 is mounted in the head cartridge, and is provided in a predetermined shape at each of the two major side surfaces 105 of the ink container 101.

More specifically, the guide portion 112 is constituted by a latch portion 112*c* disposed in the neighborhood of the major side surface 105 in a substantially inverted U-shape, a first inclined portion 112*a* extended from one end of the latch portion 112*c* toward the front side surface3 107, and a second inclined portion 112*b* extended from the other end of the latch portion 112*c* toward the rear side surface 106.

The first inclined portion 112*a* is a portion which first contacts the sliding projection 130 of the head cartridge during the mounting of the ink container 101 and an end thereof is extended to a position close to a lower right corner of the ink container 101 (FIG. 3).

The second inclined portion 112*b* is a portion which contacts the sliding projection 130 after the sliding projection 130 is detached from the first inclined portion 112*a*. Accordingly, the second inclined portion 112*b* is disposed so that an extended line (indicated by a dotted line in FIG. 3) of the first inclined portion 112*a* is located at a center position of the second inclined portion 112*b*.

Incidentally, each of the inclined portions 112*a* and 112*b* and the latch portion 112*c* may preferably have a smooth surface, since the sliding projection 130 is slided along the portion, so as to permit a smooth sliding operation. Guide surfaces of these portions may be a plane-like shape or a curve-like shape. Further, in FIG. 3, these portions 112*a* to 112*c* are shown in an integrally connected state but the present invention is not particularly limited thereto. In this embodiment, the guide portion 112 is provided at each of the two major side surfaces but may also be provided at either one of the side surfaces.

A sequence of steps when the above constituted ink container 101 is mounted in the head cartridge 120 will be described with reference to FIGS. 5(*a*) to 5(*d*).

Figure 5:
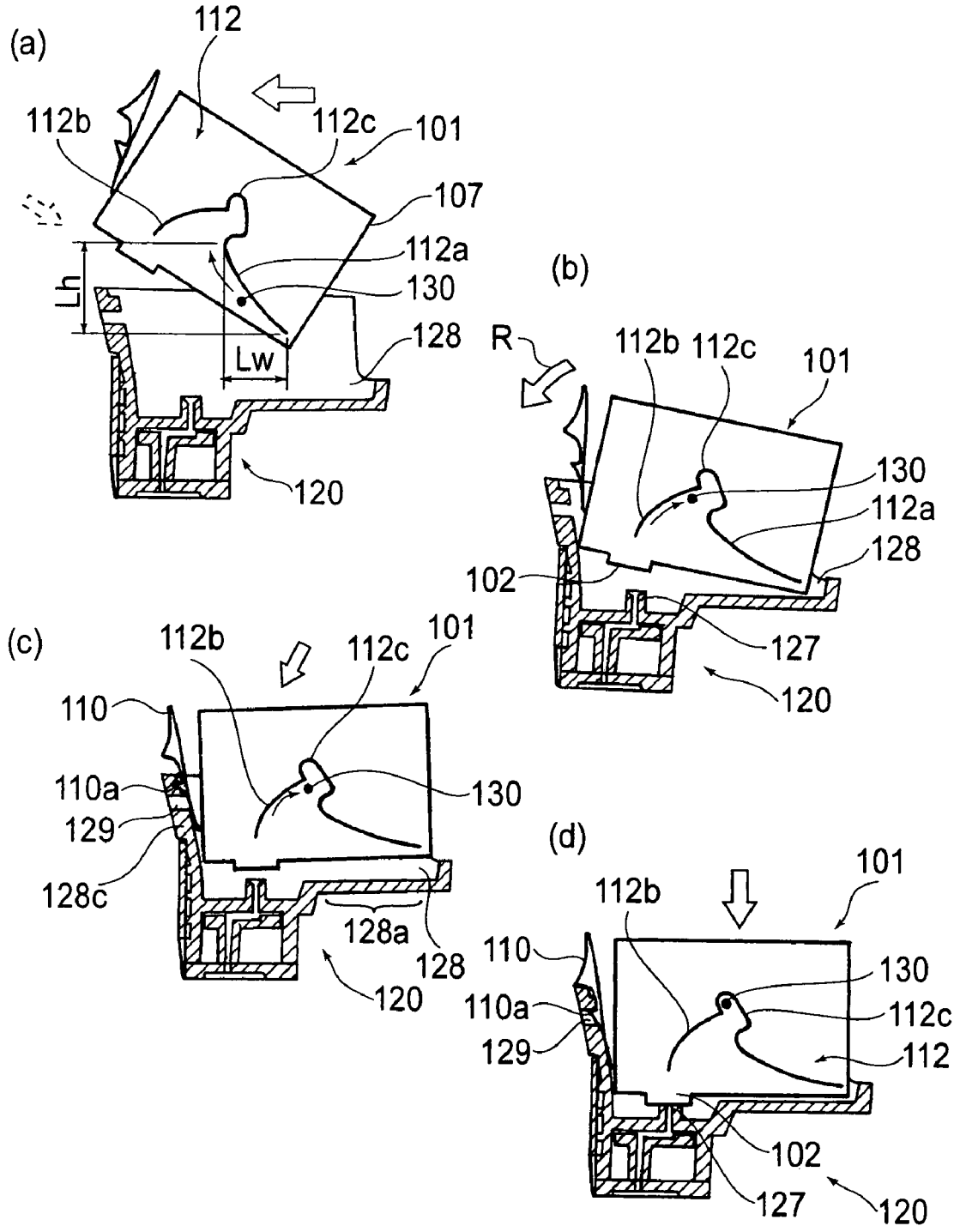
FIGS. 5(*a*) to 5(*d*) are sectional views for illustrating stepwise an example of mounting steps of the ink container.

FIGS. 5(*a*) to 5(*d*) are sectional views showing an example of the sequence of steps of mounting the ink container 121. However, the steps do not limit a mounting operation of the ink container 101 according to the present invention.

First of all, as shown in FIG. 5(*a*), a user moves the ink container 101 from the front side (the right side in the figure) in a cross direction indicated by an outlined arrow while, e.g., holding the ink container 101 in such a position that the front side surface 107 is somewhat directed downward. This movement operation is continued until the first inclined portion 112*a* contacts the sliding projection 130.

Figure 9:
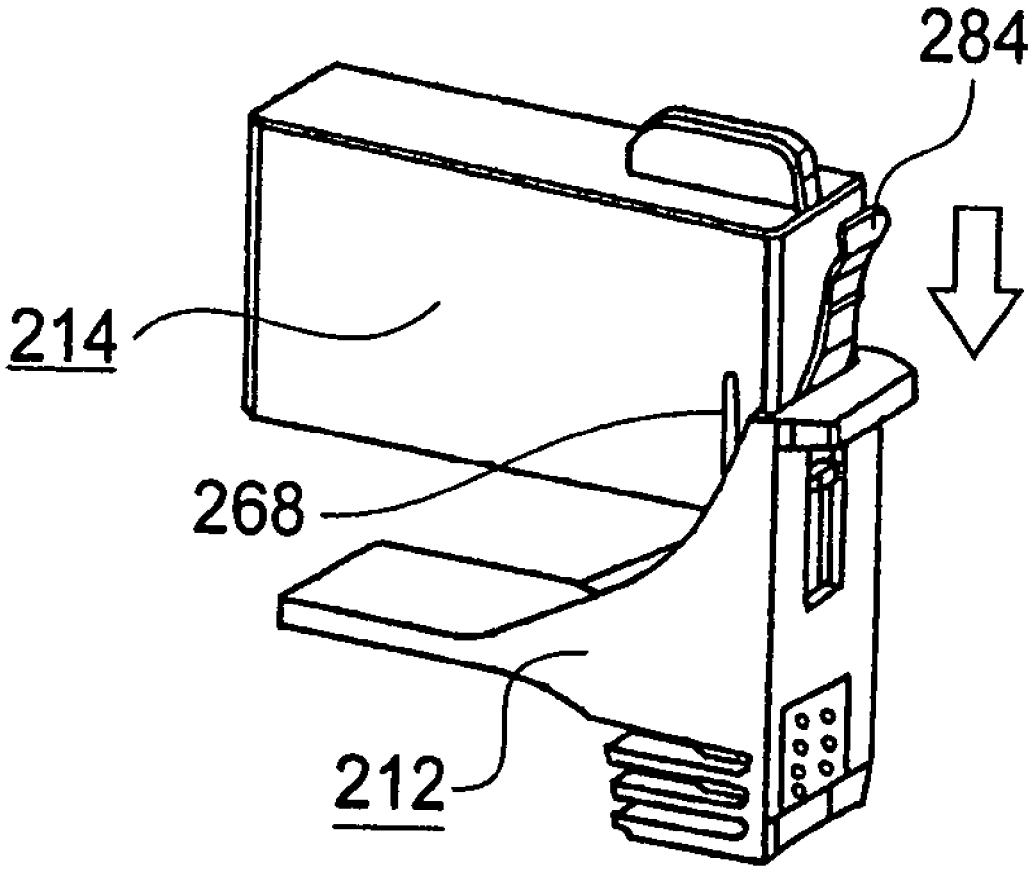
FIG.9 PRIOR ART
FIG. 9 is a perspective view showing a conventional ink container and a holder for holding the ink container.

Here, in the inclined state as shown in FIG. 5(*a*), the first inclined portion 112*a* has a length L in the cross direction and a length Lh in a vertical direction, so that compared with the constitution of the conventional ink container shown in FIG. 9, the ink container 101 is constituted so that the first inclined portion 112*a* contacts the sliding projection 130 in a broad range. As a result, the user can effect an initial step of an inserting operation with no precise positioning.

Thereafter, the user moves the entire ink container 101 in an obliquely lower right direction indicated by a dot-outlined arrow so that the sliding projection 130 slides along the first inclined portion 112*a* and approaches the second inclined portion 112*b*. Incidentally, the movement of the ink container 101 in the obliquely lower right direction can also be realized by movement of the ink container 101 by its own weight. This is because in the case where the ink container 101 is moved from the position as shown in FIG. 5(*a*) in the lower direction by its own weight, the sliding projection 130 and the first inclined portion 112*a* are in a contact state, so that they acts as a guide member and the ink container 101 is moved not only downward but also the right direction in FIG. 5(*a*).

As described above, when the ink container 101 is moved in the obliquely lower right direction, the sliding projection 130 is detached from the first inclined portion 112*a* and then contacts the second inclined portion 112*b* at its center position as shown in FIG. 5(*b*). In this state, when the user applies, e.g., a substantially downward force to the ink container 101, the sliding projection 130 is moved toward the latch portion 112*c* along the second inclined portion 112*b*. At this time, the entire ink container 101 is rotated in a counterclockwise direction as indicated by an outlined arrow R shown in FIG. 5(*b*), whereby the ink supply port5 102 of the ink container 101 approaches the joint portion 127.

Then, as shown in FIG. 5(*c*), in the state wherein the sliding projection 130 contacts the second inclined portion 112*b*, the ink container 101 is further rotated in the counterclockwise direction to be placed in a state in which the lower right corner of the ink container 101 is somewhat apart from the front holding portion 128*a*. Incidentally, FIG. 5(*c*) shows a state in which the sliding projection 130 is located at a position close to a boundary portion between the second inclined portion 112*b* and the latch portion 112*c*. In this state, the latch lever 110 abuts against the rear side wall 128*c* and starts to deform elastically in a direction toward the ink container main body.

Then, when a force in an outlined arrow is exerted on the ink container 101 placed in the state shown in FIG. 5(*c*) to move the ink container 101 in a further lower direction while deforming the latch lever 110, as shown in FIG. 5(*d*), the latch claw 110*a* of the latch lever 110 is engaged in the latch hole 129. As a result, the ink container 101 is mounted and fixed in the head cartridge 120. In this state, as shown in FIG. 5(*d*), the ink supply port 102 of the ink container 101 and the joint portion 127 are placed in a communicating state. Further, the sliding projection 130 is accommodated in the latch portion 112*c*.

Particularly, in this embodiment, in order to stabilize the fixation of the ink container 101, the following constitution is employed. More specifically, the latch lever 110 is constituted so that it has a largest amount of elastic deformation when the sliding projection 130 is moved from the second inclined portion 112*b* to the latch portion 112*c*, i.e., when the sliding projection 130 passes through the boundary portion between the second inclined portion 112*b* and the latch portion 112*c*. Further, in the state in which the ink container 101 is fixed, the entire ink container 101 is urged in the right direction on the drawing by a reaction force of the latch lever 110, so that an urging force by the latch lever 110 is exerted between the sliding projection 130 and the latch portion 112*c*. Thus, the fixation of the ink container 101 is stabilized.

As described above, according to the ink container 101 of this embodiment, when the ink container 101 is mounted in the head cartridge 120, the first inclined portion 112*a* may first contact the sliding projection 130. Here, the first inclined portion 112*a* is continuously formed in a predetermined length, so that the sliding projection 130 is caused to abut against the first inclined portion 112*a* in a relatively broad range even when the positioning by the user is somewhat deviated. Accordingly, compared with the conventional constitution, it becomes possible to simply perform the mounting operation of the ink container.

Further, the first inclined portion 112*a* has such a shape that the entire ink container 101 is moved in the obliquely lower direction, so that the mounting operation is performed by moving the ink container 101 in the obliquely lower direction (FIG. 5(*a*)) and then moving the ink container 101 in the lower direction toward the head cartridge 120 (FIGS. 5(*c*) and 5(*d*)). Accordingly, the working space above the holder during the mounting operation can be reduced, so that the ink container 101 of the present invention is also advantageous for a small-sized ink jet recording apparatus 150.

Second Embodiment

Figure 6:
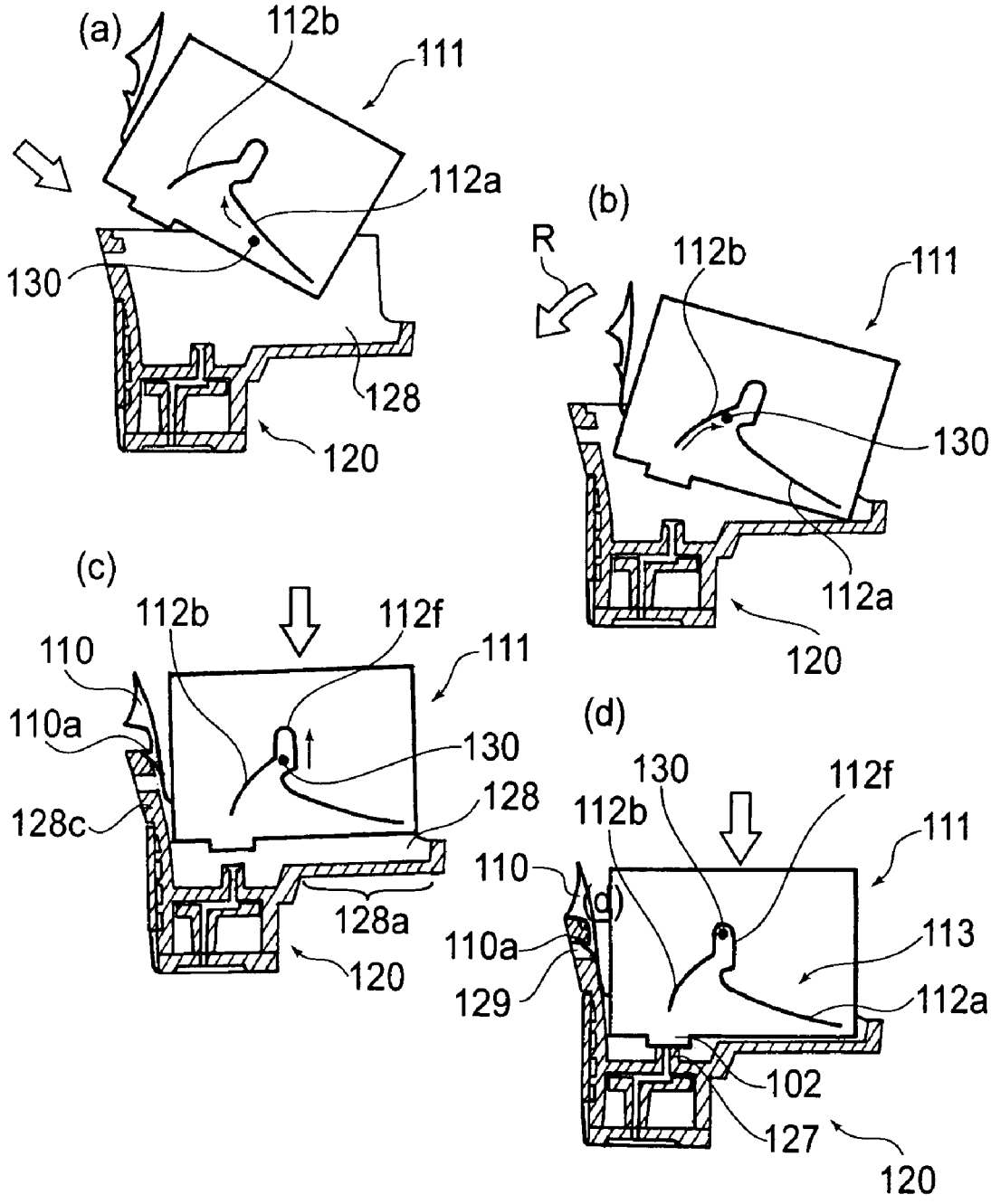
FIGS. 6(*a*) to 6(*d*) are sectional views for illustrating a constitution of an ink container used in Second Embodiment and illustrating stepwise an example of mounting steps of the ink container.

Second Embodiment of the ink container according to the present invention will be described with reference to FIGS. 6(*a*) to 6(*d*). FIGS. 6(*a*) to 6(*d*) are sectional views showing a constitution of the ink container in this embodiment and another example of a sequence of steps of mounting the ink container 111. The ink container 111 shown in FIGS. 6(*a*) to 6(*d*) has the same constitution as the ink container 101 of First Embodiment except that the shape of the guide portion 112 of the ink container 101 of First Embodiment is modified. Further, the head cartridge 120 shown in FIGS. 6(*a*) to 6(*d*) is identical to that of First Embodiment. The ink container 111 of this embodiment include a guide portion 113 as shown in FIG. 6(*d*). More specifically, the guide portion 113 is provided with a first inclined portion 112*a* and a second inclined portion 112*b* which have the substantially same shapes as those provided to the ink container 101 of First Embodiment and is provided with a vertical guide portion 112*f*, which has a substantially inverted U-shape and is extended in a vertical direction, in place of the latch portion 112*c* in First Embodiment.

The ink container 111 provided with such a guide portion 113 is mounted and fixed in the head cartridge 120 through the following steps. Incidentally, the same mounting steps as those described in First Embodiment are omitted from detailed explanation.

First of all, similarly as in the step shown in FIG. 5(*a*), as shown in FIG. 6(*a*), the ink container 111 is moved to a position where the first inclined portion 112*a* contacts the sliding projection 130 and thereafter the entire ink container 111 is moved in an obliquely lower right direction indicated by an outlined arrow shown in FIG. 6(*a*).

Then, as shown in FIG. 6(*b*, similarly as in the step shown in FIG. 5(*b*), the sliding projection 130 is slided along the second inclined portion 112*b* to rotate the entire ink container 111 in a counterclockwise direction indicated by an outlined arrow R indicated in the figure.

Next, as shown in FIG. 6(*c*), the ink container 111 is further rotated to cause its lower right corner to be somewhat away from the front holding portion 128*a* and to cause the sliding projection 130 to be located in the neighborhood of an entrance (lower end) of the vertical guide portion 112*f*. Incidentally, in this state, the latch lever 110 starts to abut against the rear side wall 128*c* to be elastically deformed.

Then, as shown in FIG. 6(*d*), a downward force is exerted on the ink container 111 to move the ink container 111 in a further lower direction. The ink container 111 is caused to move toward the right direction on the drawing by a reaction force from the latch lever 110, so that the sliding projection 130 is slided while being pressed against a left surface of the vertical guide portion 112*f* on the drawing. Here, the surface of the vertical guide portion 112*f* is formed in the vertical direction, so that the movement direction of the entire ink container 111 is also limited to the vertical direction. When the ink container 111 is moved downward to a predetermined position, the latch claw 110*a* of the latch lever 110 is engaged in the latch hole 129, whereby the ink container 111 is fixed.

As described above, according to the ink container 111, of this embodiment, provided with the guide portion 113 having the vertical guide portion 112*f*, as shown in FIGS. 6(*c*) and 6(*d*), the movement direction of the ink container 111 in the later steps of the mounting operation is the vertical direction, so that Second Embodiment is effective in the case where a joint mode of the ink supply port 102 of the ink container 111 with the joint portion 127 of the head cartridge 120 is a mode of vertically inserting a needle constituting the ink supply port into a rubber packing or a sealing member or a mode of connecting the ink supply port 102 with the joint portion 127 through an engaging member consisting of a material different from those for the ink supply port 102 and the joint portion 127. In these modes, there is no reaction force at the joint portion 127, so that the fixation of the ink container 111 can be sufficiently performed stably only by the engagement of the latch lever 110. As a result, it is not necessary to provide a latch portion to the vertical guide portion 112*f*.

Figure 7:
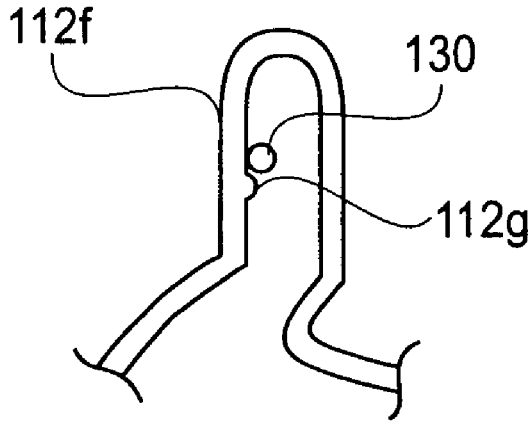
FIG. 7 is a schematic view showing a modified example of a shape of a guide portion of the ink container used in Second Embodiment.

As a modified example of this embodiment, as shown in FIG. 7, the vertical guide portion 112*f* may be provided with a projection 112*g*. FIG. 7 shows a state in which the ink container 111 has already been mounted in the head cartridge 20. The projection 112*g* is a surface, of the vertical guide portion 112*f*, against which the sliding projection 130 is pressed, and is disposed so as to be located immediately under the sliding projection 130. An amount of projecting and a shape of the projection 112*g* may preferably be set so that the sliding projection 130 can smoothly climb over the projection 112*g*. By providing such a projection 112*g*, vertical stability of the ink container 111 is further improved.

Third Embodiment

Figure 8:
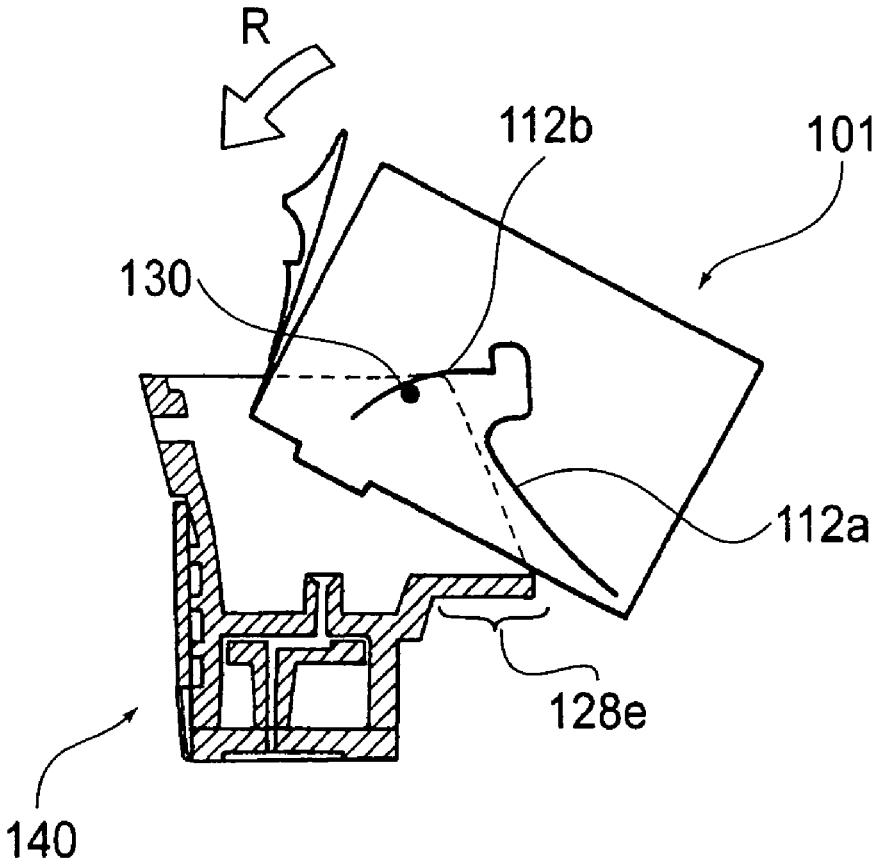
FIG. 8 is a schematic view showing a shape of a head cartridge used in Third Embodiment.

The head cartridges 120 described in First and Second Embodiments are, as shown in FIG. 3, the lower right corners of the ink containers 101 and 111 are held by the front holding portion 128*a* extended to the front (the right side on the drawing) of the head cartridge 120 but in this embodiment, the shape of the front holding portion is modified as shown in FIG. 8.

Referring to FIG. 8, a head cartridge 140 is provided with a front holding portion 128*e* which is formed in a shorter length than that of the head cartridge 120 shown in FIG. 3 by being cut largely on its front side. Incidentally, an ink container 101 shown in FIG. 8 is identical to that of First Embodiment shown in FIG. 3. FIG. 8 shows a state wherein a sliding projection 130 of the head cartridge contacts the second inclined portion 112*b*.

In the case where the ink container 101 is mounted in the thus constituted head cartridge 140, as shown in FIG. 8, the lower right corner of the ink container 101 is protruded from the front holding portion 128*e* in a lower right direction during the mounting operation. However, the sliding projection 130 and the second inclined portion 112*b* are in a contact state, so that it is possible to perform the rotation operation in an outlined arrow R, as described above with reference to FIG. 5(*b*), without causing dropping off of the ink container 101. Accordingly, according to this embodiment, in addition to the effects similar to those achieved by First Embodiment, it is possible to achieve the effect of being capable of realizing a small-sized head cartridge 140 by the front holding portion 128*e* formed in the short length. Further, in the head cartridge 140 in this embodiment, the front side wall 128*d* provided to the head cartridge 120 shown in FIG. 3 is also not formed, so that it is possible to reduce a working space above and below the head cartridge 140. More specifically, in an initial step (e.g., the step shown in FIG. 5(*a*)) of the mounting operation of the ink container 101, the ink container 101 can be moved in a horizontal direction at a relatively low position without taking the height of the front side wall 128*d* into consideration. For this reason, compared with First Embodiment, the working space in the vertical direction can be reduced in the initial step of the mounting operation.

The present invention is not limited to the above described embodiments but may be variously modified.

More specifically, the rib-like guide portion 112 at the side surface of the ink container is not limited to the rib-like shape but may also be constituted as a recess portion which is recessed with respect to the side surface of the ink container so as to form a surface contacting the sliding projection 130.

Further, in the above described embodiments, the head cartridge 120 provided with the recording head portion 121 (FIG. 2) corresponds to the holder for holding the ink container 101 but is not required to be provided with the recording head portion 121 so long as the holder can detachably hold the ink container according to the present invention. In the above description, the mounting of the ink container 101 in the holder is described as an example but the concept that the mounting path of the ink container 101 is determined by providing the guide portion 112 is also applicable to the case where the head cartridge 120 is mounted to the carriage 155. In this case, the above described guide portion at the side surface of the ink container is provided to the head cartridge 120 and the sliding projection is provided to the carriage 155 so that the head cartridge 120 can be mounted to the carriage along a predetermined mounting path.

Further, with respect to the ink container, the ink container may also be variously modified. For example, the ink container can be designed so that one ink container independently holds each color ink or integrally holds a plurality of color inks (e.g., those of three colors of cyan, magenta, and yellow). Further, ink container may also be one including a recording head and a container which are integrally formed. In addition, an interior structure of the ink container is also not particularly limited but may be one provided with a negative pressure-generating member for absorbing and holding ink.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 279839/2004 filed Sep. 27, 2004, which is hereby incorporated by reference.

What is claimed is:

1. An ink container mountable to an ink container holder for providing ink in said ink container to an ink jet printer, wherein the ink container holder includes a sliding projection, said ink container comprising:

an ink container main body which includes a supply port from which ink is supplied to the ink jet printer;

a rail-like continuous surface formed continuously at a first side surface of said ink container main body;

wherein said rail-like continuous surface includes at least a first guide surface for guiding said ink container main body to a mounting position of the ink container holder in contact with the sliding projection, and further includes a fixing surface for engaging with the sliding projection of the ink container holder to positionally fix said ink container main body to the ink container holder.

2. A container according to claim 1, wherein said ink container further comprises a latch lever extending from a second side surface of said ink container main body and being elastically deformable so as to be engaged with a part of the ink container holder to fix said ink container to the ink container holder, wherein the mounting and fixing of said ink container are completed by engaging said fixing surface with the sliding projection of the ink container holder and by engaging said latch lever with the part of the ink container holder.

3. A container according to claim 1, wherein said rail-like continuous surface is configured and positioned to be projected with respect to said side surface of said ink container main body.

4. A container according to claim 1, wherein said rail like continuous surface is configured and positioned as a groove with respect to said first side surface of said ink container main body.

* * * * *

UNITED STATES PATENT AND TRADEMARK OFFICE

CERTIFICATE OF CORRECTION

PATENT NO. : 7,396,110 B2
APPLICATION NO. : 11/234098
DATED : July 8, 2008
INVENTOR(S) : Nobuyuki Matsumoto et al.

It is certified that error appears in the above-identified patent and that said Letters Patent is hereby corrected as shown below:

COLUMN 1

Line 26, “recording made” should read --recording mode--.

COLUMN 3

Line 2, “a ink” should read --an ink--.

COLUMN 4

Line 31, “carriage 120” should read --carriage 155--;
Line 33, “medium 120” should read --medium 152--; and
Line 34, “120.” should read --152.--.

COLUMN 6

Line 16, “viewer” should read --view--;
Line 34, “finder-holding” should read --finger-holding--; and
Line 53, “surface3” should read --surface--.

COLUMN 7

Line 44, “they acts” should read --they act--; and
Line 57, “port5” should read --port--.

Signed and Sealed this

Nineteenth Day of May, 2009

JOHN DOLL
*Acting Director of the United States Patent and Trademark Office*